United States Patent [19]

Mankowski

[11] Patent Number: 4,555,889

[45] Date of Patent: Dec. 3, 1985

[54] COLLAPSIBLE WALL STUD AND BUILDING SYSTEM

[75] Inventor: Leonard E. Mankowski, Ithaca, N.Y.

[73] Assignee: Cornell Research Foundation, Inc., Ithaca, N.Y.

[21] Appl. No.: 636,432

[22] Filed: Jul. 31, 1984

[51] Int. Cl.[4] ..... E04C 3/30

[52] U.S. Cl. ..... 52/726; 52/241; 52/584

[58] Field of Search ..... 52/726, 720, 79.5, 127.6, 52/241, 243, 584, 586

[56] References Cited

U.S. PATENT DOCUMENTS

| | | | |
|---|---|---|---|
| 3,512,819 | 9/1968 | Morgan et al. | 52/586 |
| 3,882,652 | 5/1975 | Marchello | 52/127.6 |
| 3,995,402 | 12/1976 | Parenteau | 52/586 |
| 4,300,323 | 11/1981 | Meechan et al. | 52/282 |
| 4,409,906 | 10/1983 | Alneng | 52/586 X |
| 4,455,807 | 6/1984 | Ehrlich | 52/584 X |
| 4,458,462 | 7/1984 | Schold | 52/241 |

*Primary Examiner*—J. Karl Bell

*Attorney, Agent, or Firm*—Jones, Tullar & Cooper

[57] ABSTRACT

A collapsible wall stud and building system which uses the wall stud is disclosed. The collapsible wall stud includes spaced inner and outer channel members that are joined to each other by pivot arms. When the collapsible wall stud is in its fully open position, wall panels can be placed between the inner and outer channel members. As the collapsible wall stud is closed, flange portions of the channel members seat in grooves in the panels thereby joining adjacent panels to form a wall section. The wall sections are placed in floor channels and are capped by top channels to which are secured suitable roof truss elements that form a roof. The collapsible wall stud facilitates the construction of a building by one unskilled in conventional building techniques.

19 Claims, 7 Drawing Figures

COLLAPSIBLE WALL STUD AND BUILDING SYSTEM

FIELD OF THE INVENTION

The present invention is directed generally to a building system. More particularly, the present invention is directed to a building system utilizing readily assemblable components. Most specifically, the present invention is directed to a collapsible wall stud useable in a building system. The collapsible wall stud includes inner and outer channel members which are connected to each other by pivot arms for movement between an open position and a closed position. In their closed position, the channel members engage wall panels and join adjacent panels together to form wall sections. The wall sections are then used to construct a building. The collapsible wall studs are useable by a person not particularly familiar with building techniques to secure the wall panels together, in a positive, secure manner.

DESCRIPTION OF THE PRIOR ART

Affordable housing is a goal which continues to be an important and sometimes seemingly unobtainable one. As the costs of skilled labor, materials, energy, and other home construction and maintenance components continues to rise, the availability of affordable housing continues to decline. An ever increasing number of persons who desire to purchase and own their own home are discovering that even the most simple and basic homes are too expensive for them to consider. What was once the normal practice of home purchase and ownership is rapidly becoming impossible for large numbers of people.

A number of solutions to the rapidly rising home building cost problem have been proposed. While these cover a wide spectrum of ideas, a practical one has been the concept of simplified home construction. The underlying premise of this solution is that home building costs can be reduced by affording the owner of the home the opportunity to invest his time and effort in the construction, thereby reducing labor costs. One requirement of such a building concept is simplicity so that the owner, who is most likely unskilled in construction techniques and proceedures, can contribute his time and energy in a meaningful fashion. The building system and components, while being uncomplicated, must also be structurally sound so that the end product will be acceptable, not only to its owner and builder but also to the various governmental agencies involved.

The prior art is replete with so-called simplified building components and systems, all of which attempt to solve the problem of providing a means for the construction of a structurally sound, durable home. Unfortunately, a number of these components and their resultant structures are either not practical or are not actually simple. The initial concept of simplicity becomes obscured by the desire to turn the resulting structure into more than it was intended to be. The components and systems become too complex for the unskilled person who desires to at least assist in the construction of his home.

A concomitant goal of housing components and systems is adaptability. A system should be flexible enough to change with varying family demands for size as the home's occupants life cycle progresses. A starter home should be expandable as family size increases and should then also be contractable as family size is reduced. The components and structural elements should be reuseable and resaleable so that they can be disposed of by sale or trade when and if the home owner wishes to reduce the size of his home.

Energy efficiency is also an important consideration in any building component and structural system. Since one of the major costs of home ownership is the cost of energy used in heating and cooling, the system's components should allow the assemblage of an energy efficient structure. The prior art has also attempted to solve this problem but again has often failed to be able to attain the two goals of simplicity and energy efficiency. While not mutually exclusive, the two seem to be at least elusive since a component structure and system that is energy efficient also is apt to be complex and unsuited for use by the unskilled home owner.

While the prior art has attempted to solve the problem of providing affordable yet satisfactory housing, there is still a need for a building component structure and system which is both simple yet durable, which will be adaptable to the changing needs of a typical family, and which is energy efficient. The collapsible wall stud and building system in accordance with the present invention, provides such a component and system.

SUMMARY OF THE INVENTION

It is an object of the present invention to provide a collapsible wall stud, which is easy to manufacture and which is compact when shipped.

Another object of the present invention is to provide a collapsible wall stud and building system.

A further object of the present invention is to provide an option for the variation of the length of the connecting or pivot arms to allow for a variation in the wall panel thickness to accommodate the energy needs for different parts of the country.

A further object of the present invention is to provide a collapsible wall stud and interlocking wall panel.

Yet another object of the present invention is to provide a collapsible wall stud and interengaging floor channel.

Still a further object of the present invention is to provide a collapsible wall stud which is cooperative with a roof joist supporting channel.

Yet still another object of the present invention is to provide a collapsible wall stud and building system which is energy efficient.

As will be set forth in greater detail in the description of the preferred embodiment, the collapsible wall stud and building system in accordance with the present invention includes as its basic component a collapsible wall stud. Each stud is comprised of a pair of generally parallel, elongated channel members which are joined to each other in a face to face orientation by a plurality of spaced pivot arms. The two channel members are spaced furthest apart when the pivot arms are generally perpendicular to the longitudinal axis of the channel members. Movement of one channel member towards the other about the pivot arms causes inwardly directed flanges on the channel members of the collapsible wall stud to be inserted into cooperating grooves in a wall panel which has been placed between the spaced apart sections of the collapsible stud. Once the collapsible stud has been brought into engagement with the wall panel or with abutting wall panels, a wall section is formed. This wall section is then placed in a floor channel and is capped with a top channel that carries roof joist anchor brackets. The addition of interior wall board and exterior siding or the like, completes the building system in accordance with the present invention.

The collapsible wall stud of the present invention can be made in standard lengths and is uncomplicated and easily used. Movement of one of the stud channels toward the other stud channel is done in a simple manner since the two channels are joined to each other by a plurality of pivot arms. The maximum spacing of the stud channels from each other is limited by the length of the pivot arms and the minimum spacing is determined by the thickness of the wall panel being clamped or secured between the stud channels. Two wall panels are typically placed in end abutting relationship with one panel on either side of the pivot arms. The wall panels have grooves which receive flanges on the collapsible stud channel member as the two channel members are moved toward each other to collapse the stud. Joining of wall panels by use of the collapsible wall stud is thus accomplished by an unskilled person such as one who desires to build his own home.

The size of the home constructed using the collapsible wall stud in accordance with the present invention is, to a large extent, limited by the needs of the owner. Additional wall panels and collapsible wall studs can be joined together to increase the size of the house. The base of the collapsible wall studs are received in complimentarily shaped floor channels and are provided with locating and holding means. The top channel which carries the roof truss anchor brackets, is placed atop the wall sections thereby tying them together. As the size requirements of the family changes, collapsible wall studs and wall panels can be added or removed as necessary.

The collapsible wall stud and building system in accordance with the present invention provides a structure which is durable and structually sound. Further, it is energy efficient. The wall panels which are clasped between the collapsible wall studs may be made of an insulating material such as an extruded or molded foamed plastic. Such a material is also desirable from other standpoints such as lightness and ease of handling, durability, low maintenance and a general resistance to deterioration. By using adequate roof insulation and other good building techniques the house constructed in accordance with the present invention will be energy efficient.

The collapsible wall stud and building system in accordance with the present invention does provide a simple building system in which an unskilled person can participate in the construction of his home. The collapsible wall stud forms the basis of the building system and allows the joining of previously formed wall panels to each other. The collapsible wall stud and building system of the present invention provides means by which accessibility to affordable housing is increased and participation by the unskilled owner is made possible.

BRIEF DESCRIPTION OF THE DRAWINGS

While the novel features of the collapsible wall stud and building system in accordance with the present invention are set forth with particularity in the appended claims, a full and complete understanding of the invention may be had by referring to the description of the preferred embodiment as set forth hereinafter, and as may be seen in the accompanying drawings in which:

DESCRIPTION OF THE PREFERRED EMBODIMENT

Figure 1:
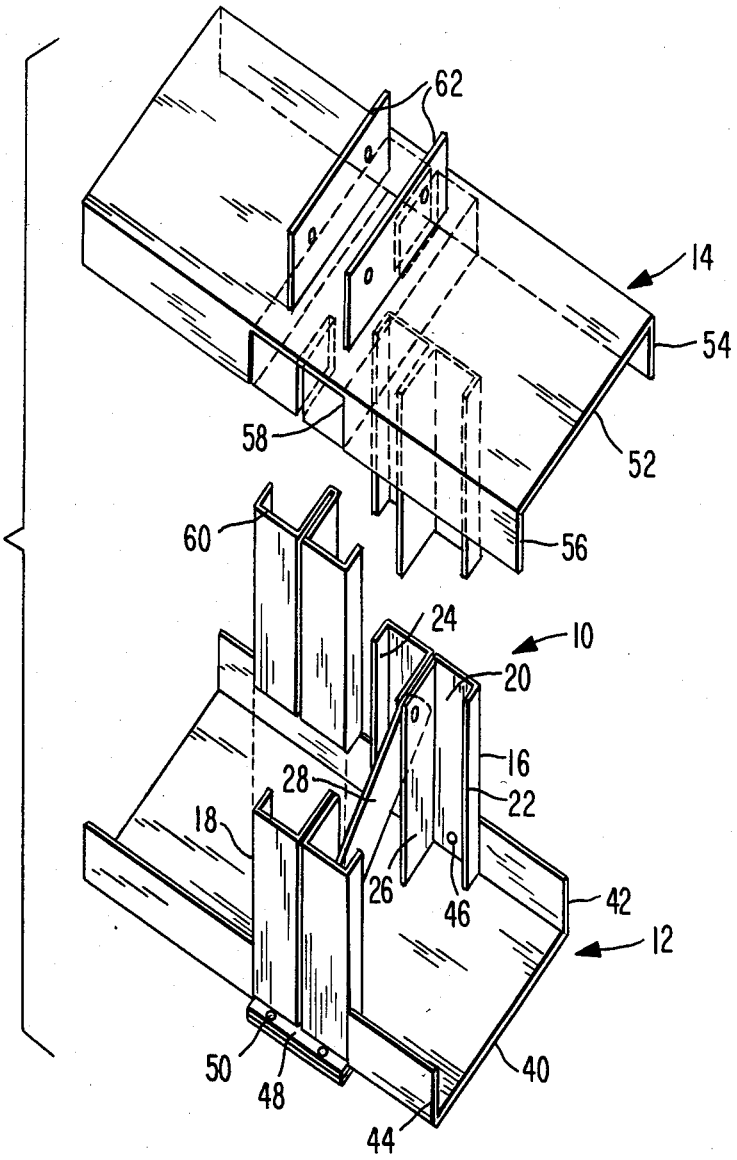
FIG. 1 is an exploded perspective view of the collapsible wall stud and floor and top channels in accordance with the present invention.

Referring initially to FIG. 1, there may be seen generally at 10 a preferred embodiment of a collapsible wall stud in accordance with the present invention. Collapsible wall stud 10 is seen in FIG. 1 supported by a floor channel member, generally at 12 and being capped by a top channel, generally at 14. These will be discussed in greater detail subsequently. As may be seen in FIG. 1, collapsible wall stud 10 is comprised of two substantially identical elongated channel members which will, for the sake of identification, be referred to as an outer channel member 16, and an inner channel member 18. Each of these channel members 16 and 18 are generally W or M shaped in cross section and have a generally planar web surface 20. End flanges 22 and 24 extend inwardly from web surface 20. These end flanges 22 and 24 are formed at generally 90° to the plane of planar web surface 20 and extend inwardly generally parallel to each other and to the longitudinal axis of planar web surface 20. Furthermore, end flanges 22 and 24 are formed generally at the ends of the elongated longitudinal sides of planar web surface 20. An intermediate flange 26 is also carried by each planar web 20 with intermediate flange 26 also extending inwardly of planar web 20, being generally parallel to end flanges 22 and 24, and extending the longitudinal length of each collapsible wall stud channel member 16 and 18.

Outer and inner channel members 16 and 18, respectively are joined to each other by two or more spaced pivot arms 28, with one such arm being seen in FIG. 1. As may be seen more clearly in FIGS. 2 and 3, each pivot arm 28 is pivotably attached at a first end 30 to intermediate flange 26 of outer channel member 16, and at a second end 32 to intermediate flange 26 of inner channel member 18. Outer and inner channel members 16 and 18 so interconnected by pivot arms 28 thus form the collapsible wall stud 10 in accordance with the present invention. Any suitable means may be used to pivotably attach the ends 30 and 32 of pivot arm 28 to the intermediate flanges 26 of the outer and inner channel members 16 and 18. For example, rivets 34 may be utilized as may any other similar fastener which provides a pivotable connection.

Figure 3:
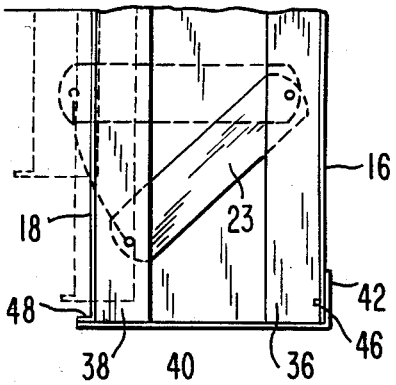
FIG. 3 is a side view of the lower portion of the collapsible wall stud and floor channel and showing the wall stud in its fully expanded position in dashed lines.

As may be seen in FIG. 3, the outer and inner channel members 16 and 18 are spaced from each other at their greatest distance when pivot arms 28 are generally perpendicular to the longitudinal axis of channel members 16 and 18. As the two channel members are moved closer to each other, the pivot arms 28 pivot in their connections with intermediate flanges 26. The length of pivot arm 28 is selected so that when the outer and inner channel members 16 and 18 are spaced from each other at the desired distance, which distance depends on the thickness of the wall panel to be interposed between the outer and inner channel members 16 and 18, the lower ends 36 and 38 of channel members 16 and 18, respectively, will be at the same height.

As may be seen in FIGS. 1 and 3, floor channel, generally at 12, is generally U-shaped in cross section and is comprised of a bottom web 40 and spaced upwardly extending bottom flanges, an outer bottom flange 42 and an inner bottom flange 44. The longitudinal axis of floor channel 12 is generally parallel to the planar web surfaces 20 of outer and inner channels 16 and 18 with the planes of the bottom flanges 42 and 44 of floor channel 12 being generally perpendicular to the planes of the end flanges 22 and 24 and the intermediate flange 26 of the outer and inner channel members 16 and 18 of collapsible wall stud 10. Outer bottom flange 42 of floor channel 12 is provided with inwardly directed locating pins 46 which pass through corresponding holes in the planar web surface 20 of outer channel member 16 to locate collapsible wall stud 10 in floor channel 12. The inner bottom flange 44 of floor channel 12 is suitably notched to cooperate with the lower end 38 of inner channel member 18 thus securely locating collapsible wall stud 10 in floor channel 12. Inner channel member 18 additionally has an interior, directed up 48 at its lower end 38. Suitable securement means such as nails 50 can be driven through lip 48 to secure it to the floor of the building.

Figure 2:
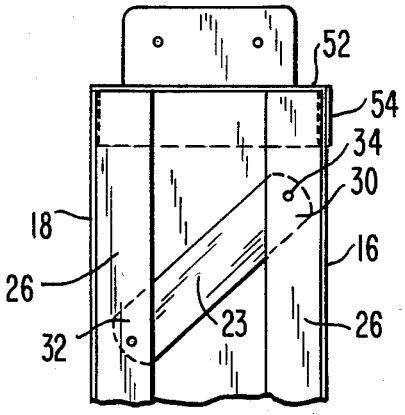
FIG. 2 is a side view of an upper portion of the collapsible wall stud and top channel of the present invention.

Top channel 14, as seen in FIGS. 1 and 2 is generally similar in shape and structure to floor channel 12. It includes a top web 52 and downwardly extending top flanges, an outer top flange 54 and an inner top flange 56. As with floor channel 12, top channel 14 can be provided with suitable locator pins. A notched portion 58 of inner top flange 56 is provided to receive an upper end 60 of inner channel member 18. Top web 52 of top channel 14 includes spaced, upwardly, extending anchor plates 62 which are used for securement of a truss bearing connector for the roof system, as will be discussed subsequently.

Figure 4:
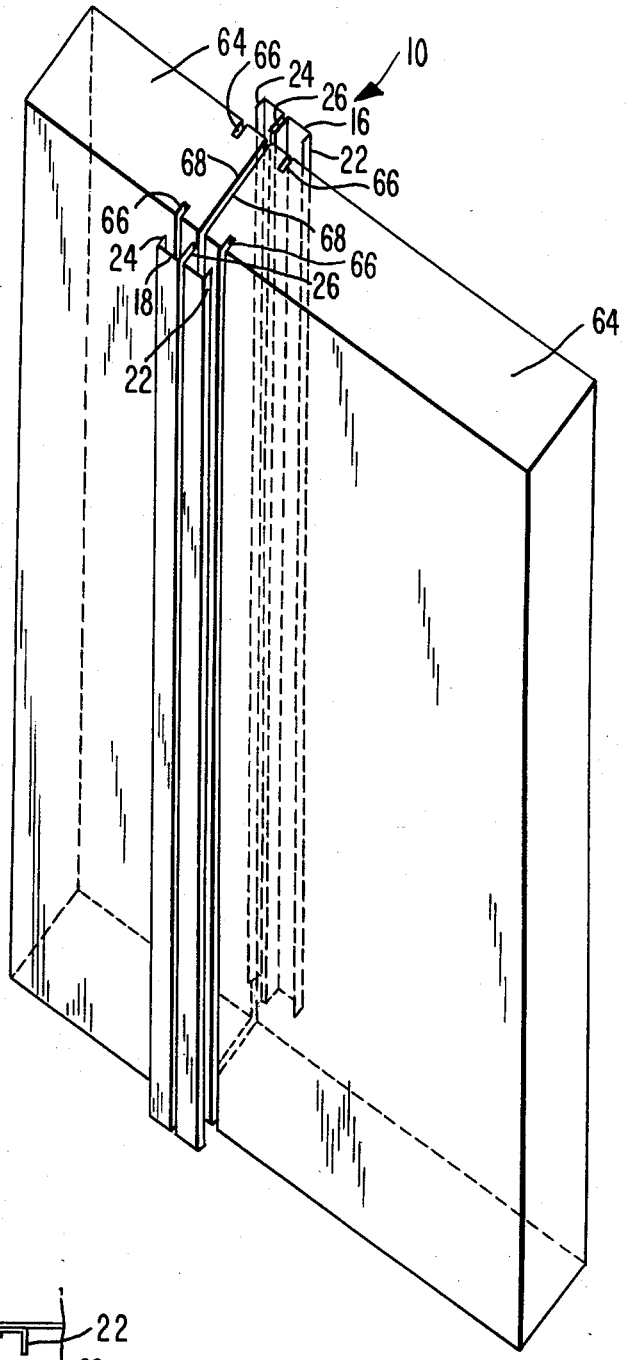
FIG. 4 is a perspective view of the collapsible wall stud expanded and overlying two wall panels.
Figure 5:
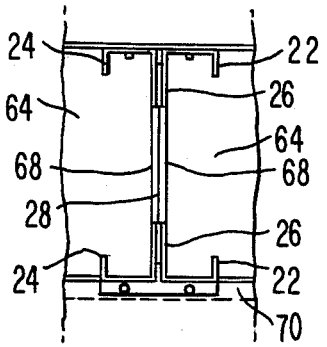
FIG. 5 is a top plan view of the collapsible wall stud in place engaging two cooperatively shaped wall panels.

Turning now to FIGS. 4 and 5, there may be seen the use of collapsible wall stud 10 to form a wall section by joining together wall panel elements 64. Each wall panel 64 is preferably formed of a foamed insulation material of a known composition in a thickness commensurate with the desired final wall thickness and with the spacing between the outer and inner channel members 16 and 18, respectively of collapsible wall stud 10. Each wall panel is formed having elongated grooves or slots 66 which extend generally vertically the full height of wall elements 64 and are set back from the ends 68 of panels 60 a distance which corresponds with the spacing of end flanges 22 and 24 from intermediate flange 26 on outer and inner channel members 16 and 18, respectively of collapsible wall stud 10. In assembly, as seen in FIGS. 4 and 5, collapsible wall stud 10 is opened to its full extent to the position shown in dashed lines in FIG. 3. This allows sufficient space between the channel members 16 and 18 for the insertion of ends 68 of wall panels 64. Once the panel ends 68 are nearly abutting each other, with their contact with each other being limited only by the thickness of pivot arms 28, the collapsible wall stud 10 is closed to the position shown in FIGS. 2 and 5, and in solid lines in FIG. 4. The end flanges 22 and 24 seat in grooves 66 and serve to clamp the wall panels 64 together to form a wall system. It will be understood that the closing of collapsible stud 10 if desired can be accomplished before the wall system is placed in floor channel 12. Once so placed collapsible stud 10 and wall panels 64 are then topped with top channel 14 and suitable fasteners such as nails 50 are driven through lip 48. As may be seen in FIG. 5, an interior facing of gypsum board 70 can then be applied to the inner surface of the wall panels 64 in a conventional manner. It will now be appreciated that the collapsible wall stud in accordance with the present invention allows the secure joining of wall panels in a simple, quick, and efficient manner which is accomplishable by one generally unskilled in carpentry and the like. Once the collapsible wall stud 10 has been closed to engage the wall panels 64 and the stud 10 has been secured in floor channel 12 and capped by top channel 14, the assembly provides a load bearing wall which can be utilized in the construction of a home or other building.

Figure 6:
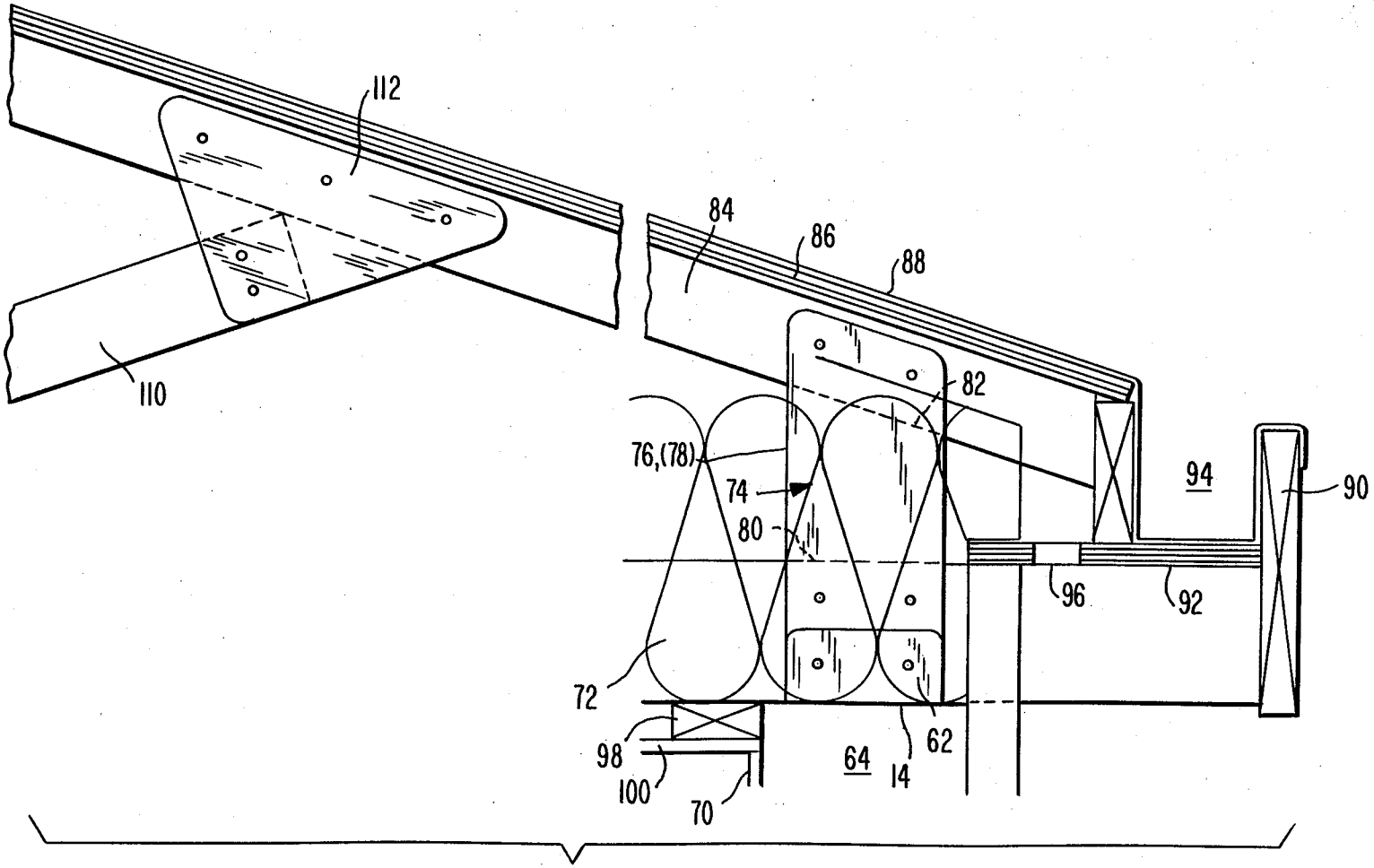
FIG. 6 is a side elevation view of the top channel and roof joist assembly of the present invention.
Figure 7:
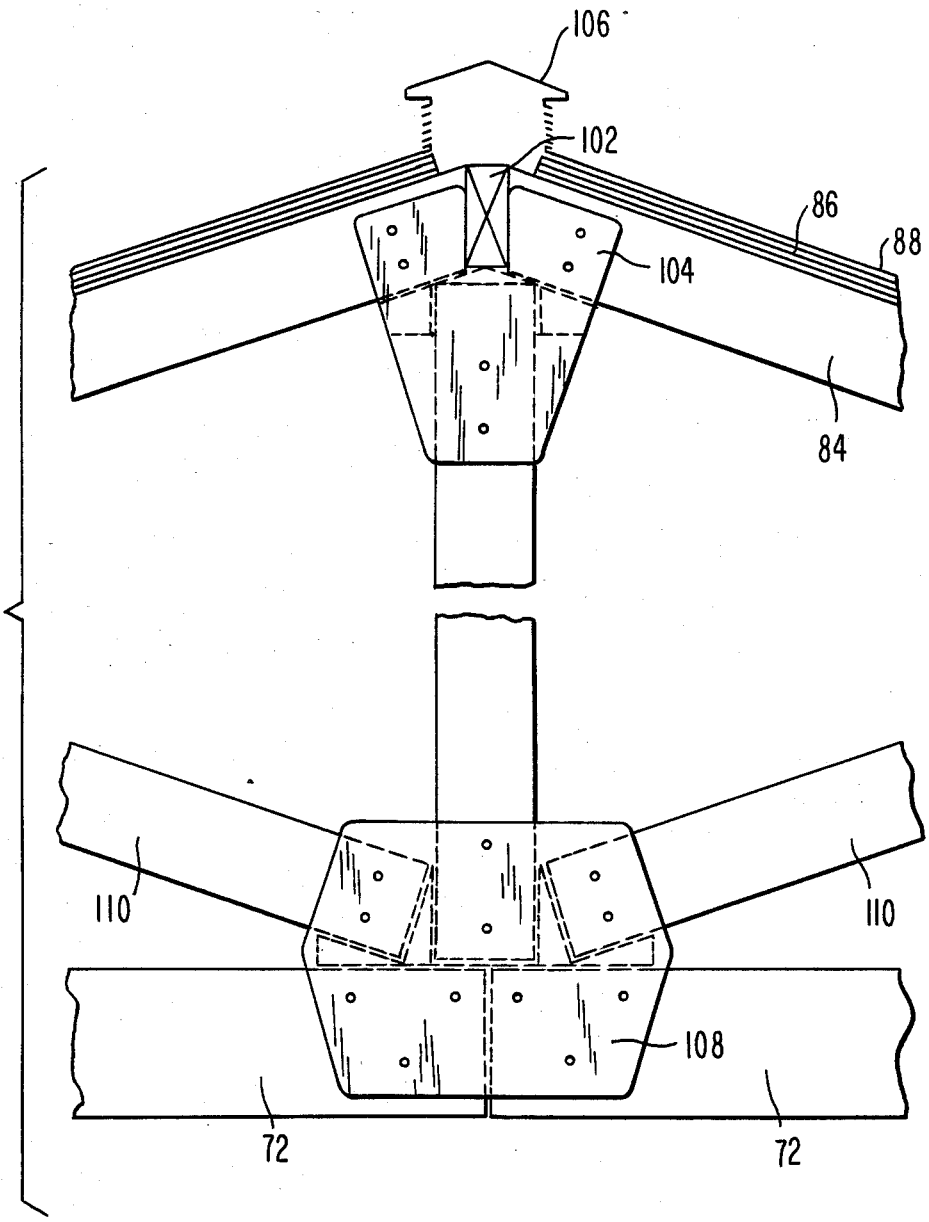
FIG. 7 is a side elevation view of the roof peak of the building system in accordance with the present invention.

Turning now to FIGS. 6 and 7, there may be seen a roof for use with the collapsible wall stud and building system in accordance with the present invention. Referring initially to FIG. 6, a wall panel 64 which is topped by top channel 14 may be seen. If desired, a protective exterior finishing siding material or additional insulation 65 may be secured to the exterior of wall panels 64. Anchor plates 62 serve as guides for a horizontal roof truss 72 which typically is a 2"×6" wooden beam. A truss bearing connector 74 is secured to anchor plates 62. Truss bearing connector is constructed of two generally rectangular galvanized metal plates 76 and 78, spaced from each other at a distance corresponding to the spacing of anchor plates 62. A generally horizontal web 80 is secured between plates 76 and 78 to overlie horizontal roof truss 72, and an inclined web plate 82 cooperates with the upper ends of plates 76 and 78 to form a socket for an inclined roof beam 84. Exterior plywood sheathing 86 is secured to roof beams 84 and a roof membrane 88 is applied over the sheathing.

Horizontal roof truss 72 extends outwardly beyond the wall panels 64 and provides support for a vertical fascia board 90. A horizontal trim board 92, which may also be exterior plywood sheathing, is secured to the upper surface of the portion of the horizontal roof trusses 72 which extend beyond wall panels 64. The roof membrane 88 is extended beyond the edge of the roof sheathing 86, over the trim board 92 and onto fascia board 90 to form a rain gutter 94. Trim board 92 may also have a conventional vent means 96 to allow air circulation in the attic space. Suitable furring strips 98 may be attached to the lower edge of horizontal roof trusses or beams 72 to serve as a securement means for the ceiling gypsum board 100 or other ceiling paneling.

As seen in FIGS. 6 and 7, the inclined roof beams 84 join at the peak of the roof where they are tied together with a ridge beam 102 by a truss ridge connector 104. The roof membrane 88 is joined to a continuous ridge vent 106 which cooperates with the vents 96 to facilitate air circulation. A bottom chord truss midpoint connector 108 is positioned below the ridge of the roof and connects the two horizontal roof trusses 72 which extend inwardly to the center of the structure. Diagonal trusses 110 also are received by bottom chord truss midpoint connector 108 and extend outwardly and upwardly to top chord truss midpoint connectors 112. The resulting roof assembly is both structurally sound and uncomplicated in construction thereby cooperating with the collapsible wall stud and wall panels joined therewith to provide a building structure that can be erected in large part by a person who is not particularly skilled in conventional home building techniques from a relatively small compact shipping package.

It will thus be seen that the collapsible wall stud and building system in accordance with the present invention provides the means for allowing an unskilled person to contribute a substantial portion of the labor required to construct his home. The collapsible wall studs are easily handled and securely engage the wall panels to lock them together, thereby forming wall sections. These wall sections can then be secured in floor channels and held by top channels which, in turn, provide support for the roof beams and trusses. The preformed wall panels lend themselves to the inclusion of various wiring and the like during their fabrication. A central heating/plumbing core for the building may also be provided with it being necessary only to properly locate it and connect the various water and electrical lines. The building constructed using collapsible wall studs in accordance with the present invention is easily constructed, is energy efficient, can be readily adapted to changing family size, and is made in such a manner that various components can be used more than once.

While a collapsible wall stud and building system in accordance with the present invention have been fully and completely set forth hereinabove, it will be obvious to one of skill in the art that a number of changes in, for example, the composition of the wall panels, the sizing of the panels, the type of roofing materials, and the like could be made without departing from the true scope and spirit of the invention and that accordingly, the invention is to be limited only by the following claims.

I claim:

1. A collapsible wall stud and building system for use in constructing a building, said collapsible wall stud and building system comprising:

a collapsible wall stud having spaced, generally parallel outer and inner channel members, said channel members being connected to each other by spaced, transverse pivot arms and movable between open and closed positions;

at least first and second wall panels, end portions of said wall panels being receivable between said outer and inner channel members in said open position and being engaged by said outer and inner channel members in said closed position to form a wall section;

means to secure a lower portion of said collapsible wall stud to a floor portion of the building; and means to secure a roof structure to upper positions of said collapsible wall studs.

2. The collapsible wall stud and building system of claim 1 wherein said outer and inner channel members have spaced end flanges and a planar interconnecting web portion.

3. The collapsible wall stud and building system of claim 2 wherein said planar web portion further carries an intermediate flange positioned between said end flanges.

4. The collapsible wall stud and building system of claim 3 further wherein said end flanges and said intermediate flange are generally parallel to each other and are generally perpendicular to the plane of said planar web portion.

5. The collapsible wall stud and building system of claim 3 wherein said pivot arms extend between, and are pivotably attached to said intermediate flanges.

6. The collapsible wall stud and building system of claim 2 wherein each of said wall panels includes elongated grooves adjacent said end portions.

7. The collapsible wall stud and building system of claim 6 wherein said end flanges of said channel members are receivable in said elongated grooves when said channel members are in said closed position.

8. The collapsible wall stud and building system of claim 1 wherein said means to secure said lower portion of said collapsible wall stud to a floor portion of the building includes an elongated floor channel having a bottom web and spaced outer and inner bottom flanges, said lower portion of said collapsible wall stud being positional in said floor channel.

9. The collapsible wall stud and building system of claim 8 wherein one of said bottom flanges includes spaced locating pins which are positionable in apertures in one of said channel members of said collapsible wall stud to locate said collapsible wall stud in said floor channel.

10. The collapsible wall stud and building system of claim 1 wherein said means to secure a lower portion of said collapsible wall stud to a floor portion of the building includes a lip at a lower end of one of said channel members, said lip being generally parallel to the floor and perpendicular to the plane of said channel member whereby said collapsible wall stud may be secured to the building floor by passage of fastening means through said lip and into the floor.

11. The collapsible wall stud and building system of claim 1 wherein a top channel overlies said collapsible wall studs and wall panels.

12. The collapsible wall stud and building system of claim 11 wherein said top channel includes a top web and spaced top flanges, said top web being generally perpendicular to the plane of said outer and inner channel members, said top flanges being generally perpendicular to said top web.

13. The collapsible wall stud and building system of claim 12 wherein said top channel includes spaced anchor plates, said anchor plates being adapted to engage roof truss bearing connector means so that roof trusses may be secured to said wall sections.

14. A collapsible wall stud for use in joining wall panels together to form wall sections, said collapsible wall stud comprising:

an inner channel member and an outer channel member, said channel members being spaced from each other and generally parallel to each other; and spaced pivot arms connecting said inner and outer channel members to each other for relative movement with respect to each other between an open position in which ends of the wall panels are positionable between said channel members, and a closed position in which ends of the wall panels are engaged by said channel members.

15. The collapsible wall stud of claim 14 wherein said outer and inner channel members have spaced end flanges and a planar interconnecting web portion.

16. The collapsible wall stud of claim 15 wherein said planar web portion further carries an intermediate flange positioned between said end flanges.

17. The collapsible wall stud of claim 16 further wherein said end flanges and said intermediate flange are generally parallel to each other and are generally perpendicular to the plane of said planar web portion.

18. The collapsible wall stud of claim 14 wherein said pivot arms extend between said outer and inner channel members generally parallel to the direction of motion of said channel members with respect to each other.

19. The collapsible wall stud of claim 14 wherein said channel members each include a planar web surface and spaced end flanges and an intermediate flange, said end and intermediate flanges being generally parallel to each other and generally perpendicular to the plane of said planar web surface, and further wherein said pivot arms are pivotably connected to and extend between said intermediate flanges.

* * * * *